United States Patent [19]

Burns et al.

[11] 3,979,573

[45] Sept. 7, 1976

[54] MICROWAVE OVEN DOOR HINGE

[75] Inventors: Richard H. Burns; William J. Walthour, both of Troy, Ohio

[73] Assignee: Hobart Corporation, Troy, Ohio

[22] Filed: Feb. 14, 1975

[21] Appl. No.: 549,965

[52] U.S. Cl. ..... 219/10.55 D; 126/191

[51] Int. Cl.[2] ..... H05B 9/06

[58] Field of Search ..... 219/10.55 D; 126/191, 126/197, 194, 198; 292/61, 69, 71, DIG. 7

[56] References Cited

UNITED STATES PATENTS

| | | | |
|---|---|---|---|
| 3,157,176 | 11/1964 | Pearce et al. | 126/191 X |
| 3,343,904 | 9/1967 | Laug | 126/191 X |
| 3,756,219 | 9/1973 | Snyder et al. | 126/191 |

*Primary Examiner*—Arthur T. Grimley

*Attorney, Agent, or Firm*—Biebel, French & Nauman

[57] ABSTRACT

A microwave oven has an up-opening oven door which is hinged to be movable in an arcuate path. The door moves between a closed lower position covering an aperture to the cooking cavity in the front surface of the oven cabinet and an open upper position above the aperture. The axis of this arcuate motion is adjacent the upper edge of the oven door and internal to the oven cabinet. Connecting arms extend from pivots within the cabinet through openings in the front surface of the oven cabinet, and connect to the oven door. The front surface of the oven cabinet above the aperture is recessed such that the oven door may be opened substantially beyond a horizontal position to provide access to the oven cooking cavity.

7 Claims, 5 Drawing Figures

MICROWAVE OVEN DOOR HINGE

BACKGROUND OF THE INVENTION

The present invention relates to a unique hinge arrangement to be used in a microwave oven having an up-opening door. Microwave heating appliances have gained popularity in recent years, particularly in commercial food operations such as in restaurants and hospitals. It is especially desirable in such use to provide an oven with a cooking cavity which is extended in width such that more than one food item may be cooked simultaneously. With such an oven, an oven door hinged at its side edge is impractical because when it is opened, too much of the counter space in front of the oven will be obstructed. Downward opening doors are not preferred for the same reason and also because an operator may be tempted to place items on the door when loading and unloading the oven, thus possibly impairing the radiation sealing characteristics of the door.

A door designed to open upwardly, however, necessarily would be required to open through an angle significantly greater than 90°. This is because most microwave ovens will be placed on a counter top at waist level and if the oven door does not open beyond a horizontal position, access to the cooking cavity of the microwave oven will be substantially impaired.

An additional problem in a commercial food preparation environment has been maintaining the cooking equipment in an extremely clean and sanitary condition. Some hinge arrangements used in the past have been difficult to clean. A "piano" hinge, such as shown in U.S. Pat. Nos. 3,767,884, and 3,544,751, has proved particularly difficult to clean due to the large number of crevices between interfitting hinge parts. U.S. Pat. Nos. 3,736,398 and 3,849,623 illustrate a hinge arrangement in which two individual hinges are mounted on the exterior of the oven cabinet. Such an arrangement is less likely to collect grease but still presents a cleaning problem.

One approach taken to permit easier cleaning of the oven and its associated hinge is illustrated in U.S. Pat. Nos. 3,196,242; 3,846,608; and 3,749,875. These patents show the use of a hidden hinge which has two hinge plates passing through openings in the oven cabinet to allow for a hinge point which is internal to the cabinet. This type of hinge moves the oven door away from the face of the oven cabinet as the door is opened, thus permitting the face of the cabinet to be thoroughly cleaned. Such a hinge arrangement, however, has heretofore been used only with ovens having downwardly opening doors. This is because previous hidden hinges of this type have been limited to approximately 90° arcuate travel and, as discussed above, an up-opening door used with a microwave oven must have a substantial amount of arcuate travel to allow easy access to the cooking cavity.

SUMMARY OF THE INVENTION

In accordance with the present invention, a microwave oven is provided having an oven cabinet with an internal cooking cavity and an aperture in the front surface of the cabinet defining a plane. This aperture provides access to the cooking cavity. An oven door controls this aperture, having a closed lower position in which the door covers the aperture and an open upper position above the aperture in which the aperture is fully uncovered. A pivotal supporting means is connected to the door at its upper edge and extends through the front surface of the cabinet to a hinge point internal to the cabinet. The upper front surface of the oven cabinet, above the aperture, is recessed such that, when the door is in its opened position, a portion of the door is rearward of the plane defined by the aperture, thereby permitting the door to be opened substantially beyond a horizontal position. The pivotal supporting means also provides a point of attachment for a counter-balance mechanism which aids an operator in opening and closing the oven door.

Accordingly it is an object of the present invention to provide a microwave oven having an up-opening door which is hinged such that it rotates about a hinge point internal to the cabinet of the oven; to provide such an oven in which the arcuate path of the oven door from its closed to its fully opened position is substantially greater than 90°; to provide such an oven in which the oven door, as it opens, moves away from the front of the oven cabinet to allow the cabinet to be easily cleaned; and to provide such an oven in which the upper front portion of the cabinet is recessed to permit complete opening of the oven door.

Other objects and advantages of the invention will be apparent from the following description, the accompanying drawings and the appended claims.

DESCRIPTION OF THE PREFERRED EMBODIMENT

Figure 1:
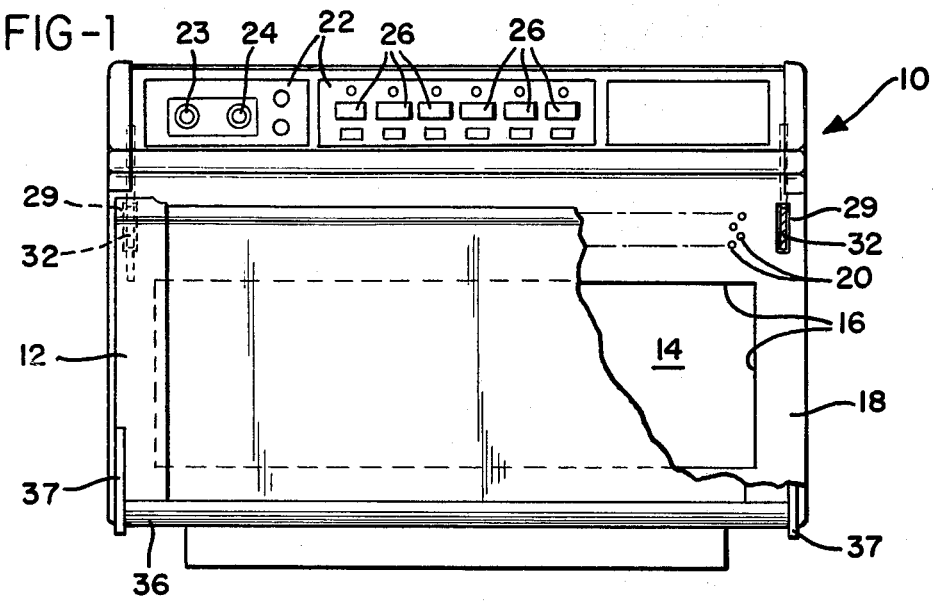
FIG. 1 is a front view of a microwave oven illustrating a preferred embodiment of the present invention with part of the door structure broken away.

Referring to FIG. 1, which illustrates a preferred embodiment of the invention, there is shown a microwave oven 10 having a door 12 which is partially broken away to reveal cooking cavity 14. An aperture 16 in the front surface 18 of the oven cabinet provides access to the cooking cavity. A number of vent holes 20 are provided in the front wall of the cabinet to permit gases to escape from the cavity 14 while food is being cooked. It is to be understood that these holes are of sufficiently small size that radiation leakage is prevented. The door extends across, but does not seal, the vent holes 20, and as seen in FIG. 1 the door covers essentially all the front of the cabinet except an upper control panel section. The control panel 22 is provided above the aperture to the cooking cavity. An ON switch 23 and an OFF switch 24 control the application of power to the control circuit and to a magnetron (not shown) which provides the microwave cooking energy to the cavity 14. A plurality of touch responsive switches 26 are used to set the cooking time period for oven operation. The touch responsive controls for the oven are disclosed and claimed in copending applicaton Ser. No. 549,922 (Docket 6048), filed on even date herewith and assigned to the assignee of the present invention. Two openings 29 in the front wall 18 of the oven cabinet permit pivotal supporting means 32 to be mounted behind the front wall and extend a connecting arm means through the front wall to attach to the oven door 12 near its upper edge.

A latch bar 36 extends between two plates 37 which are attached to a latching arrangement (not shown) internal to the door 12. This latch arrangement cooperates with strikes 40, shown in FIGS. 2 and 3, to provide a means for latching the door 12 in its closed position.

Figure 2:
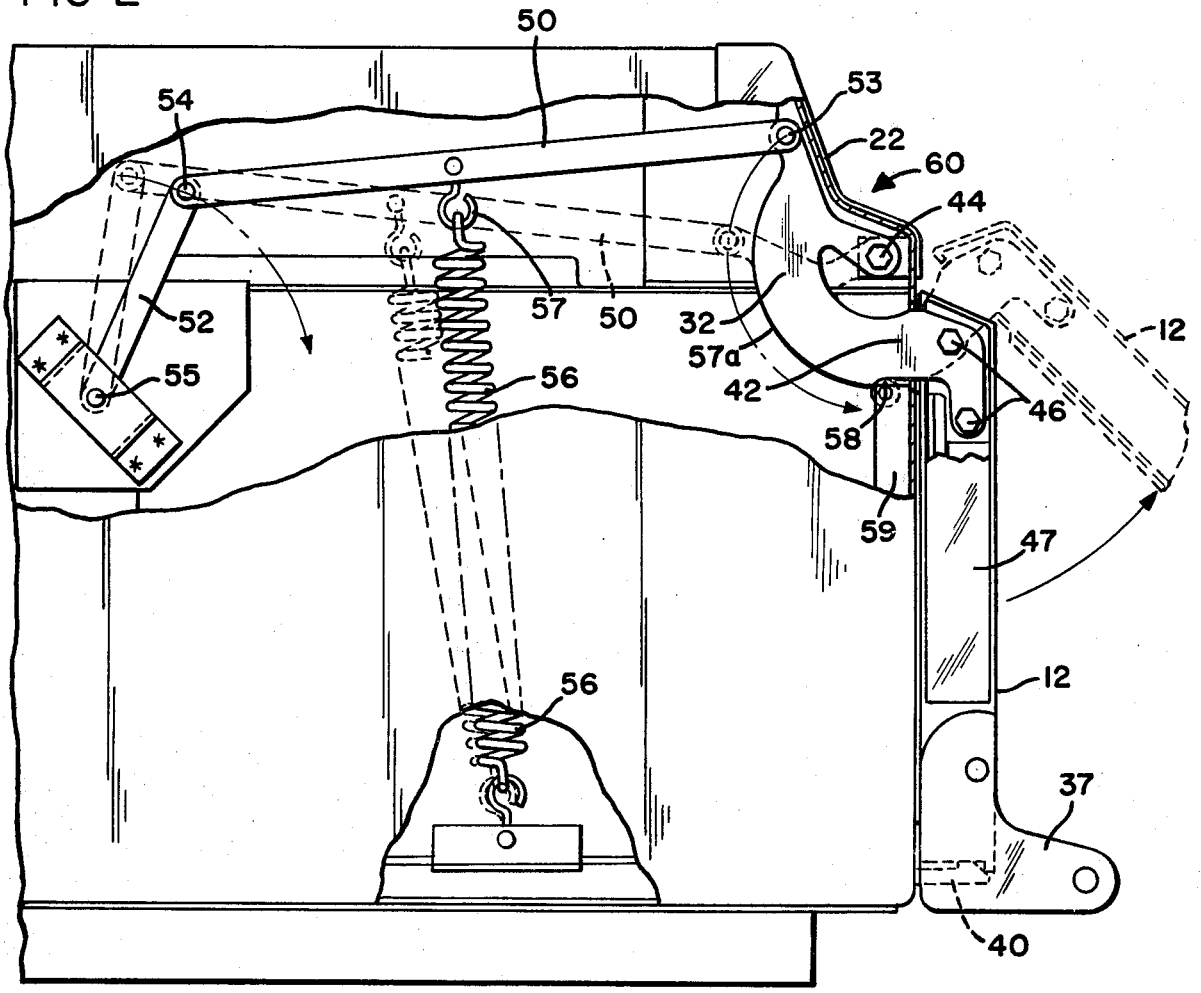
FIG. 2 is a side view of the oven with part of the door and oven cabinet broken away to reveal internal structure.
Figure 3:
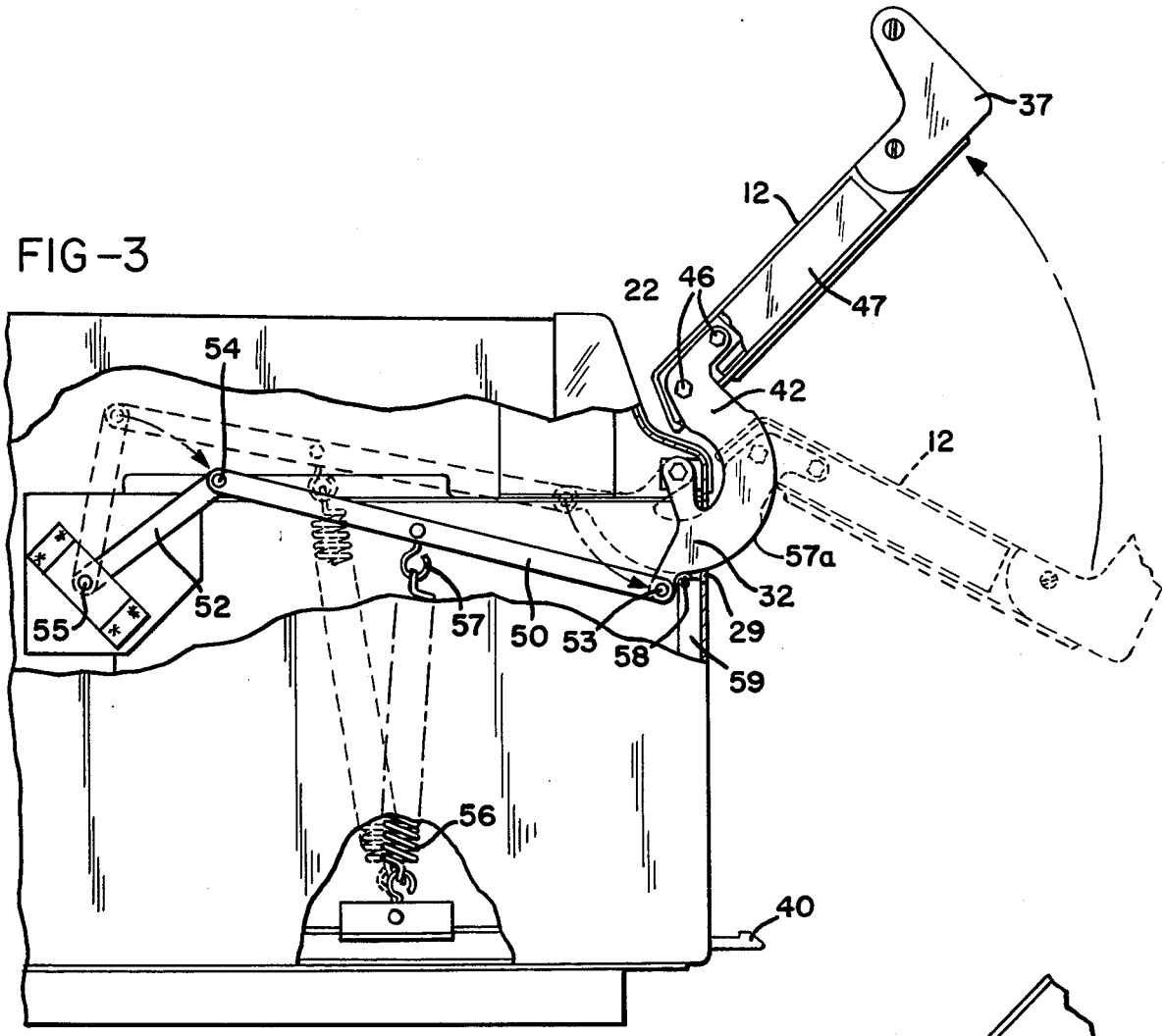
FIG. 3 is a view similar to FIG. 2 showing the door in its opened position.

The pivotal supporting means 32 including connecting arm means 42 is shown more clearly in FIGS. 2 and 3. The supporting means 32 is connected to the cabinet by stud 44 and pivots about this point. Connecting arm 42 is fixed to door 12 by two bolts 46 concealed by plate 47. The pivotal supporting means 32 provides a convenient point of attachment for a counter-balance mechanism which includes links 50 and 52, pivot connections 53 and 54 between the links and arm means 42, fixed pivot 55, and spring 56 which is anchored at one end to the cabinet and connected at its other end to a hook 57 on link 50. When the door is opened a sufficient amount, approximated by the dashed line positions in FIGS. 2 and 3, the counterbalance mechanism aids in lifting the door 12 to its opened position, which is shown in FIG. 3. The counter-balance mechanism is described and claimed in copending application, Ser. No. 549,921 (Docket 6084), assigned to the assignee of the present invention and filed on even date herewith.

Pivotal supporting means 32 also includes a cam surface 57*a* upon which roller 58 rides. The roller 58 is connected to plunger 59 which in turn is connected to a safety interlock for the oven. The shape of cam surface 57*a* is such that when door 12 is opened, plunger 59 is depressed and the operation of the oven is prevented. The interlock arrangement is disclosed more fully and claimed in copending application, Ser. No. 549,964 (Docket 6047), filed on even date herewith and assigned to the assignee of the present applicaton. As shown in FIG. 3, the roller 58 and cam surface 57*a* also act to limit the upward travel of the oven door when the door reaches its upper opened position.

Figure 4:
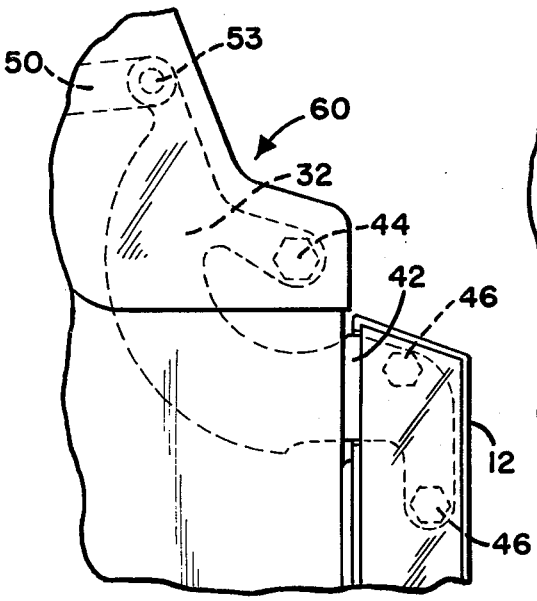
FIG. 4 is a partial side view of the oven with the door closed.

FIG. 4 is a partial side view of the oven cabinet and door illustrating the manner in which the pivotal supporting means 32 is concealed when the door 12 is closed. It should be noted that connecting arm means 42 is concealed when the door is closed except for a small portion which is visible from the side of the oven.

Figure 5:
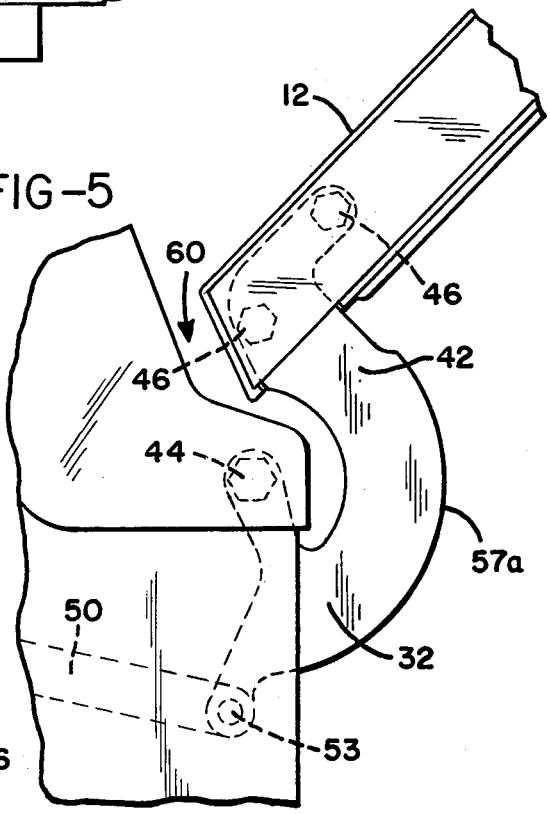
FIG. 5 is a partial side view of the oven with the door opened.

FIG. 5 shows how the recess 60 in the upper front surface of the oven cabinet, above the aperture 16, allows the door to travel in an arcuate path which is substantially greater than 90°. This wide opening angle permits easy access to the cooking cavity even when the oven is mounted at waist level. When completely opened the door shields the control panel so as to prevent accidental touching of the controls. It should be further noted that the hinge arrangement of the preferred embodiment moves the door outwardly from the front face of the cabinet so that cleaning the cabinet is facilitated.

While the form of apparatus herein described constitutes a preferred embodiment of the invention, it is to be understood that the invention is not limited to this precise form of apparatus, and that changes may be made therein without departing from the scope of the invention.

What is claimed is:

1. In a microwave oven which includes a cabinet defined by side, top, bottom, rear walls, and a front wall with a substantially vertically arranged aperture therein defining a plane, said walls defining a heating cavity accessible through said aperture, and a source of microwave energy coupled to the interior of said cavity, the improvement comprising:

a cavity closing door movable in an arcuate path about an axis adjacent to the upper portion of said door between a closed lower position covering said aperture and an open upper position above said aperture, pivotal supporting means pivotally mounted behind said front wall at a point which is above said door when said door is in its closed lower position and including connecting arm means extending through the plane of said front wall and rigidly attached to said door, and a rearwardly recessed surface above said aperture to permit the arcuate path of said door between said closed lower position and said open upper position substantially to exceed 90°.

2. The microwave oven of claim 1 further comprising biasing means connected to said connecting arm means for holding said door in its open position.

3. The microwave oven of claim 1 in which a control panel is mounted on said rearwardly recessed surface.

4. A microwave oven having an upwardly opening door comprising:

an oven cabinet having an internal cooking cavity and an aperture in the front surface of said cabinet to said cooking cavity, said aperture defining a plane, an oven door, having a closed position in which said door covers said aperture and an opened position in which said aperture is fully uncovered, pivotal supporting means rigidly connected to said door near the upper edge of said door and to said cabinet at a hinge point internal to said cabinet about which said door rotates, and a recess in the upper front surface of said oven cabinet, above said aperture, such that when said door is in said opened position, said upper edge of said door is rearward of the plane defined by said aperture.

5. The microwave oven of claim 4 further comprising biasing means connected to said pivotal supporting means for biasing said door to its opened position.

6. The microwave oven door of claim 4 wherein said hinge point is directly beneath said recess.

7. The microwave oven of claim 4 wherein said oven door, when in a closed position, covers substantially all of said front surface of said cabinet except for said recess in the upper front surface of said oven cabinet and wherein a control panel for controlling oven operation is located in said recess.

* * * * *